US007628146B2

(12) United States Patent
Kloppenburg et al.

(10) Patent No.: US 7,628,146 B2
(45) Date of Patent: Dec. 8, 2009

(54) DEVICE AND METHOD FOR CORRECTING THE INJECTION BEHAVIOR OF AN INJECTOR

(75) Inventors: Ernst Kloppenburg, Ditzingen (DE); Frieder Necker, Stuttgart (DE); Le-Thanh-Son Tran, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/666,476

(22) PCT Filed: Oct. 14, 2005

(86) PCT No.: PCT/EP2005/055276

§ 371 (c)(1),
(2), (4) Date: Sep. 10, 2007

(87) PCT Pub. No.: WO2006/048372

PCT Pub. Date: May 11, 2006

(65) Prior Publication Data

US 2008/0077306 A1 Mar. 27, 2008

(30) Foreign Application Priority Data

Nov. 4, 2004 (DE) ..... 10 2004 053 266

(51) Int. Cl.
*F02M 51/00* (2006.01)
*F02D 41/34* (2006.01)

(52) U.S. Cl. ..... 123/673; 123/674; 123/486

(58) Field of Classification Search ..... 123/478, 123/480, 486, 490, 673, 674
See application file for complete search history.

(56) References Cited

U.S. PATENT DOCUMENTS

| | | | | |
|---|---|---|---|---|
| 4,276,602 | A * | 6/1981 | Obara et al. | 701/115 |
| 5,575,264 | A * | 11/1996 | Barron | 123/486 |
| 6,085,142 | A * | 7/2000 | Di Leo et al. | 701/104 |
| RE37,807 | E * | 7/2002 | Shinogle et al. | 123/480 |
| 6,584,962 | B2 * | 7/2003 | Nonomura et al. | 123/491 |
| 6,671,611 | B1 * | 12/2003 | Peltier | 701/104 |
| 6,745,620 | B2 * | 6/2004 | Kreikemeier et al. | 73/114.72 |
| 7,093,586 | B2 * | 8/2006 | Mattes | 123/478 |
| 7,359,792 | B2 * | 4/2008 | Nishie | 701/104 |
| 2003/0154956 | A1 * | 8/2003 | Eckerle et al. | 123/357 |

FOREIGN PATENT DOCUMENTS

| | | |
|---|---|---|
| DE | 102 15 610 | 10/2002 |
| DE | 102 32 356 | 1/2004 |
| DE | 102 56 240 | 6/2004 |
| JP | 2001090592 | 4/2001 |
| JP | 2004116523 | 4/2004 |
| WO | WO 2004016928 A1 * | 2/2004 |

* cited by examiner

*Primary Examiner*—Erick Solis
(74) *Attorney, Agent, or Firm*—Kenyon & Kenyon LLP

(57) ABSTRACT

A device for correcting the injection behavior of at least one injector includes an apparatus for storing information relating to the at least one injector and means for controlling the at least one injector. The device takes the stored information into account in the correction, the information having been ascertained by comparing setpoint values with actual values individually at a plurality of test points of the at least one injector, the information being activation times for an activation time correction map of the at least one injector.

17 Claims, 3 Drawing Sheets

DEVICE AND METHOD FOR CORRECTING THE INJECTION BEHAVIOR OF AN INJECTOR

BACKGROUND OF THE INVENTION

1. Field of the Invention

The present invention relates to a device and a method for correcting the injection behavior of at least one injector, by ascertaining information about the at least one injector by comparing setpoint values with actual values individually at a plurality of test points of the at least one injector.

2. Description of Related Art

A device according and a method for correcting the injection behavior of at least one injector, in which the correction information is correction quantities for a quantity correction map of the injector, are described in published German patent document DE 102 15 610. In the case of this device, which is also known as IMA (individual quantity comparison device), and the method, the activation time is corrected in relation to a nominal characteristic map 210 (see FIG. 2) in a control unit individually for each injector, as a function of the setpoint quantity and rail pressure, thereby approximating a desired setpoint quantity as closely as possible. For example, four test values from manufacturing, for example the injection quantity at four different test points, are stored in the control unit during installation for each injector. A correction quantity map 220 (see FIG. 2) is established from these variables, using interpolation methods, as a function of the setpoint quantity and fuel pressure. This characteristic map is essentially a quantity error map. At a given rail pressure, a corrected quantity requirement is then calculated in the control unit for a setpoint injection quantity, using the quantity error map. On this basis, inverted nominal characteristic map 210 of the injector is then used to determine an activation time. An example of this type of quantity correction at one of the test points is described on the basis of FIG. 3, error-free measurements being assumed. During the injector test, a quantity $q_{p,\ actual}$, which deviates by $\Delta q$ from nominal quantity $q_{p,\ setpoint}$, is measured for activation time $t_p$. During injector operation, therefore, a quantity requirement $q_{p,setpoint}$ is then reduced by $\Delta q$ to $q_{mod}$, which results in an activation time $t_{corr}$ via the nominal characteristic. If the real and nominal characteristics are parallel, quantity $Q_{p,setpoint}$ is injected by the injector activated for an activation time $t_{corr}$. However, if the two characteristics are not parallel, the resulting injection quantity $q_{corr}$ is not equal to the quantity requirement, even though the injector was tested at the appropriate point.

Devices and methods of this type are used, in particular, for electrically operated injectors for injecting diesel fuel, for example in common rail systems. In the case of common rail injection, pressure generation is decoupled from the injection process. The injection pressure is generated independently of the engine speed and injection quantity, and is provided in the rail for injection. The injection time and quantity are calculated in the electronic engine control unit and transferred from an injector to each engine cylinder via a remote-controlled valve.

A problem with the method described above is the fact that the quantity requirement is first corrected, and the injector characteristic is applied only afterwards. This means that the slope of the injector characteristic must remain constant in the area of the monitored operating point and correspond to the slope of the nominal characteristic. However, these are highly simplified assumptions, which in large parts of the working area do not apply and thus impair the accuracy of the method.

BRIEF SUMMARY OF THE INVENTION

The present invention has the advantage over the related art in that the injector-specific quantity comparison is carried out directly at the level of the activation time. This substantially increases the precision of the injected fuel quantities. In particular, a constant characteristic slope does not have to be assumed in the proximity of the test points, as is the case with the aforementioned conventional method according to the related art. In addition, neither a correspondence between the slopes of the nominal and real characteristics, nor a known shape of the injection characteristic, needs to be assumed. Another great advantage is that the activation time correction determined for the individual test points is more easily transferable to the entire pressure setpoint quantity map than it is in the case of a quantity error map. This substantially improves the accuracy of the individual quantity comparison and expands the applicability of the method to wider classes of applications.

The means for controlling the injectors may be integrated into an engine control unit. The injector-specific control and the associated correction are also carried out by the engine control unit.

The apparatus for storing the information relating to the injector may include, for example, a data memory attached to the injector; resistors situated on the injector; bar codes situated on the injector or, for example, a label; and an alphanumeric encryption captured by a camera.

According to an example embodiment, an integrated semiconductor circuit situated on the injector is used as the apparatus for storing information. An integrated semiconductor circuit of this type is integratable, for example, in the injector head.

The data used by the control unit may be stored in a nonvolatile memory in the integrated semiconductor circuit.

The engine control unit may also include an integrated semiconductor circuit which may be used to process information stored in integrated semiconductor circuits of the injectors and thereby achieve injector-specific control.

DETAILED DESCRIPTION OF THE INVENTION

Figure 1:
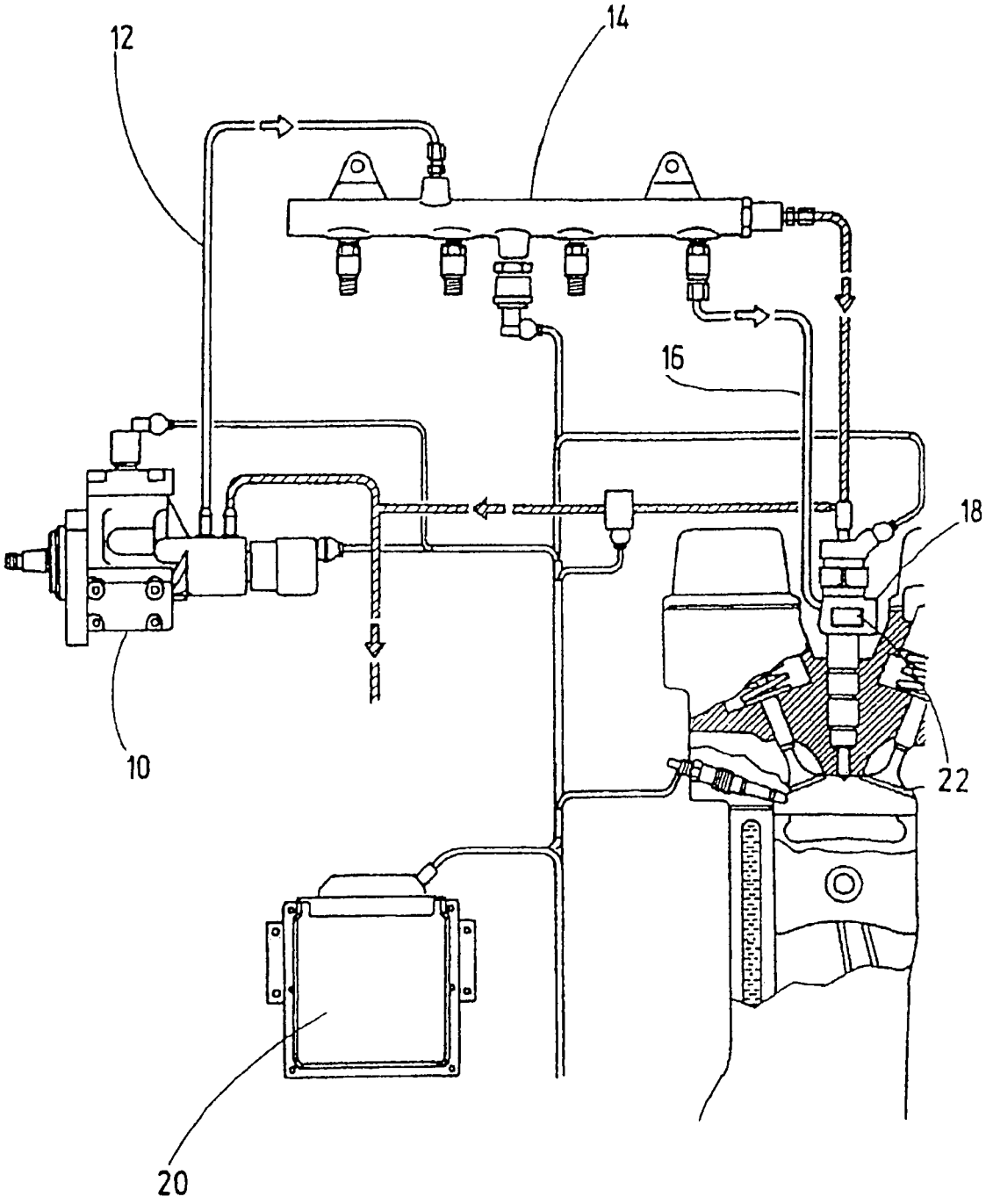
Fig.1 (Related Art)
FIG. 1 shows a schematic representation of part of a conventional common rail system.

FIG. 1 shows the high pressure part of a common rail injection system known from the related art. Only the main components and those components necessary for an understanding of the present invention are explained in greater detail below. The system includes a high-pressure pump 10, which communicates with high pressure storage unit (rail) 14 via a high pressure line 12. High pressure storage unit 14 is connected to the injectors via additional high pressure lines.

In the present representation, one high pressure line 16 and one injector 18 are shown. Injector 18 is part of an engine of a motor vehicle. The illustrated system is controlled by an engine control unit 20. Injector 18, in particular, is controlled by engine control unit 20.

Figure 2:
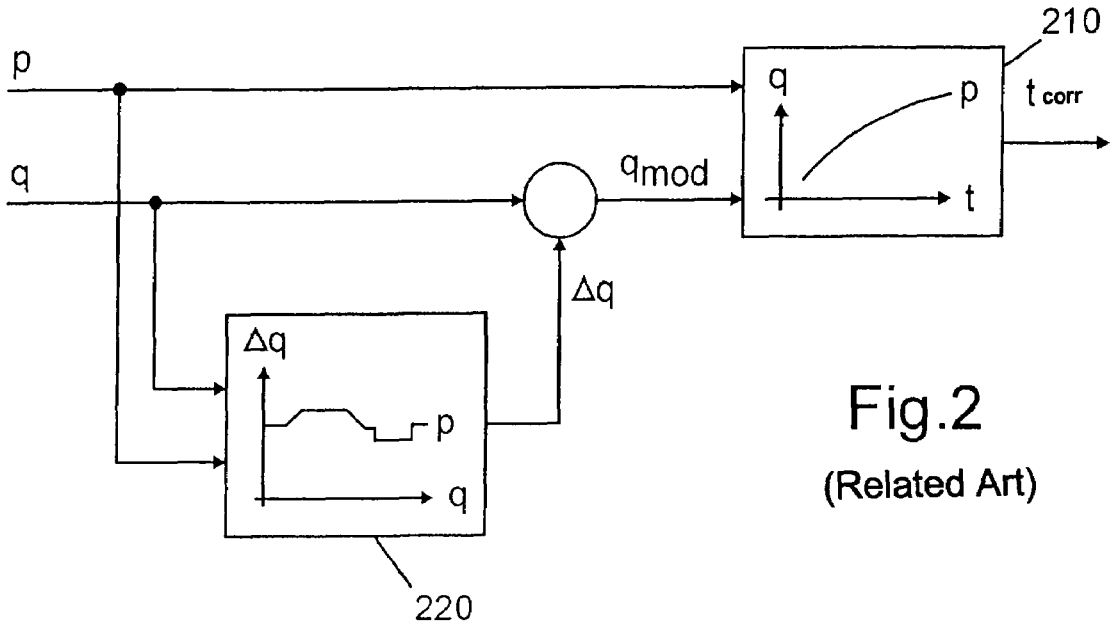
Fig.2 (Related Art)
FIG. 2 shows the correction over the quantity error according to a conventional method.
Figure 3:
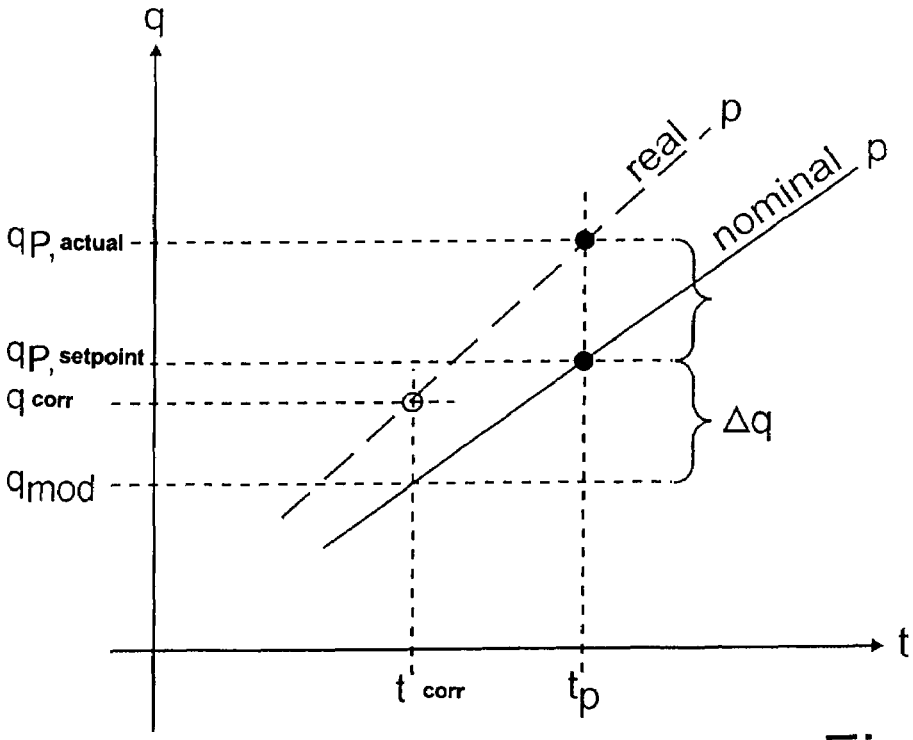
Fig.3 (Related Art)
FIG. 3 shows a schematic representation of the effect of a slope deviation in the correction over the quantity error at one test point, according to a conventional method.

An apparatus 22 for storing information relating individually to injector 18 is provided on or in injector 18. The information stored in apparatus 22 may be taken into account by engine control unit 20 in such a way that each injector 18 is controllable individually. The information may be correction values for the quantity characteristic map of injector 18 which are ascertained in the manner described above in connection with FIGS. 2 and 3. Apparatus 22 for storing the information may be implemented as a data memory, as one or more electrical resistors, as a bar code, by alphanumeric encryption, or by an integrated semiconductor circuit situated on or in injector 18. Engine control unit 20 may also include an integrated semiconductor circuit for evaluating the information stored in apparatus 22.

Figure 4:
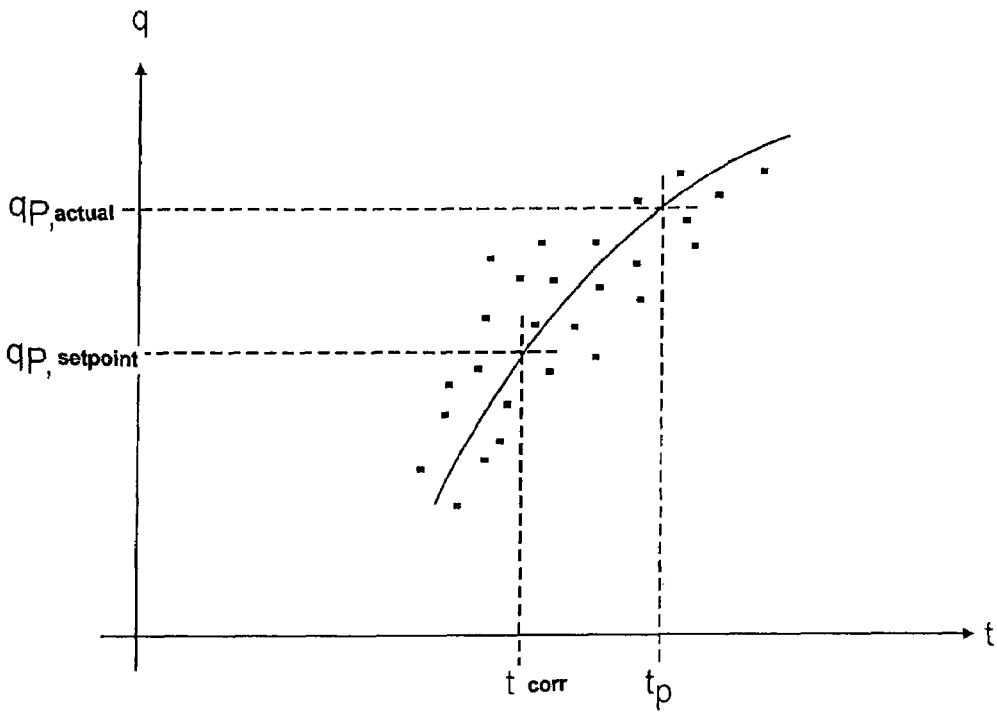
FIG. 4 shows the quantity correction according to the present invention by changing the activation time.
Figure 5:
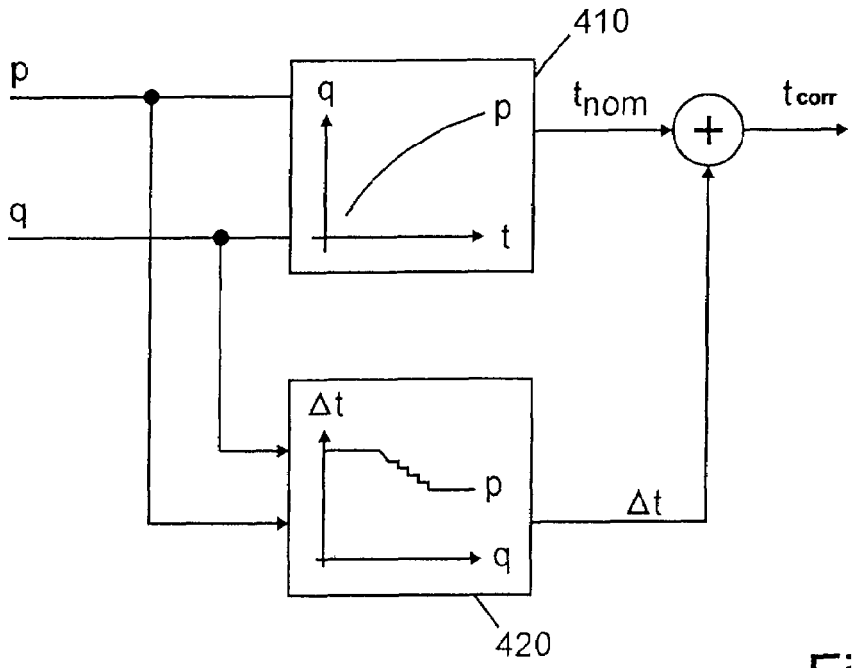
FIG. 5 shows a schematic representation of the determination of a characteristic curve segment as well as the corrected activation time according to the method of the present invention.

The system according to the present invention and the method according to the present invention are explained in greater detail below in connection with FIGS. 4 and 5.

A section of the "quantity over activation time" characteristics is measured for each of a plurality of test points on mounted injector 18. The following procedure is used to ensure that the test time is not, or is only slightly, prolonged. To equalize the stroke-to-stroke scatter at a test point, a certain number of consecutive injections, for example 50, having different activation times are carried out within a suitably determined range (sweep). Since these quantity values are subject to stroke-to-stroke scatter, as mentioned above, an equalizing regression curve, which represents a section of the injector characteristic for the given rail pressure as shown schematically in FIG. 4, is set by the data points. This characteristic makes it possible to determine, for the test point, activation time correction $T_p - T_{corr}$ necessary to achieve setpoint injection quantity $q_{p,\ setpoint}$. Apart from measurement errors, this makes it possible, in principle, to perform a precise quantity correction at the test point. If necessary, the characteristic curve section may also be extrapolated in this step.

The number and selection of test points measured in this manner must be determined with regard to the required accuracy of the activation time correction and other factors. The range over which the activation time is varied during the measurements depends on the maximum activation time correction to be expected for each test point.

The information relating to the measurement results of the activation time correction must be recorded for each injector 18, so that it will be available, if necessary, during later operation of injector 18 after installation in the engine. Apparatus 22 is used for storing the information.

The information relating to the activation time correction at different test points of injector 18 is used in control unit 20 to calculate an activation time correction over the entire range of setpoint quantity rail pressures. This may be done in the same manner as the calculation of the quantity error map known from the related art, for example published German patent document DE 102 15 610, and the method described as IMA. Nominal activation time $t_{nom}$ is determined in the control unit from the setpoint quantity and rail pressure, using a nominal characteristic map 410 (see FIG. 5). At the same time, an activation time correction $\Delta t$ is determined in the aforementioned manner in a circuit unit 420. Activation time $t_{corr}$ to be used results from the sum of the two values $t_{nom}$ and $\Delta t$.

What is claimed is:

1. A device for correcting an injection behavior of at least one fuel injector, comprising:

an apparatus for storing information relating to the at least one fuel injector;

a controller for controlling the at least one fuel injector;

wherein the information stored in the apparatus is ascertained by performing a plurality of consecutive injections having different activation times on the at least one fuel injector that define a plurality of test points of the at least one fuel injector, determining an actual injection quantity value at each one of the plurality of test points of the at least one fuel injector, and comparing the actual injection quantity value with a setpoint injection quantity value at each one of the plurality of test points of the at least one fuel injector, wherein the information stored in the apparatus includes activation times, wherein the information stored in the apparatus is used to determine an activation-time-correction map of the at least one fuel injector, and wherein the controller takes into account the activation-time-correction map of the at least one fuel injector to control the at least one fuel injector.

2. The device as recited in claim 1, wherein the controller for controlling the at least one fuel injector is integrated in an engine control unit.

3. The device as recited in claim 2, wherein the apparatus for storing information is a data memory mounted one of on and in the at least one fuel injector.

4. The device as recited in claim 2, wherein the apparatus for storing information includes one of a bar code situated on the at least one injector, a data matrix, and resistors situated on the at least one injector.

5. The device as recited in claim 2, wherein the apparatus for storing information is configured to implement information storage by one of: a) alphanumeric encryption; and b) plain text on a label of the at least one fuel injector.

6. The device as recited in claim 2, wherein the apparatus for storing information is an integrated semiconductor circuit situated one of on and in the at least one fuel injector.

7. The device as recited in claim 2, wherein the engine control unit uses the stored information to calculate an individual activation-time-correction map for the at least one fuel injector, and wherein the engine control unit corrects at least one of an injection quantity and an injection point for the at least one fuel injector according to the activation-time-correction map.

8. The device as recited in claim 2, wherein the engine control unit includes an integrated semiconductor circuit.

9. A method for correcting an injection behavior of at least one fuel injector, comprising:

ascertaining information relating to the at least one fuel injector, wherein the information is ascertained by performing a plurality of consecutive injections having different activation times on the at least one fuel injector that define a plurality of test points of the at least one fuel injector, determining an actual injection quantity value at each one of the plurality of test points of the at least one fuel injector, and comparing the actual injection quantity value with a setpoint injection quantity value at each one of the plurality of test points of the at least one fuel injector, wherein the ascertained information includes activation times;

storing the ascertained information in a storage medium;

determining an activation-time-correction map of the at least one fuel injector by taking into account the information stored in the storage medium; and controlling, by a controller, the at least one fuel injector by taking into account the activation-time-correction map of the at least one fuel injector.

10. The method as recited in claim 9, wherein a portion of an injection quantity activation time characteristic is determined at each test point of the at least one fuel injector by a plurality of measurements having varying activation times, and wherein an activation time correction is ascertained from the portion of the injection quantity activation time characteristic by comparing the setpoint value with the actual value of the injected quantity.

11. The method as recited in claim 9, wherein the controller is integrated in an engine control unit.

12. The method as recited in claim 11, wherein the storage medium is a data memory mounted one of on and in the at least one fuel injector.

13. The method as recited in claim 11, wherein the storage medium includes one of a bar code situated on the at least one injector, a data matrix, and resistors situated on the at least one injector.

14. The method as recited in claim 11, wherein the storage is implemented by one of: a) alphanumeric encryption; and b) plain text on a label of the at least one fuel injector.

15. The method as recited in claim 11, wherein the storage medium is an integrated semiconductor circuit situated one of on and in the at least one fuel injector.

16. The method as recited in claim 9, further comprising:

calculating an individual activation-time-correction map for the at least one fuel injector by using the stored information; and correcting at least one of an injection quantity and an injection point for the at least one fuel injector according to the activation-time-correction map.

17. The device as recited in claim 1, wherein a portion of an injection quantity activation time characteristic is determined at each test point of the at least one fuel injector by a plurality of measurements having varying activation times, and wherein an activation time correction is ascertained from the portion of the injection quantity activation time characteristic by comparing the setpoint value with the actual value of the injected quantity.

* * * * *